United States Patent [19]

Berggren et al.

[11] Patent Number: 4,939,331

[45] Date of Patent: Jul. 3, 1990

[54] ARRANGEMENT FOR CONTROLLING THE MICROWAVE POWER OF MAGNETRONS

[75] Inventors: Benny Berggren, Vällingby; Larsgöran Gustafsson, Uttran, both of Sweden

[73] Assignee: Alfastar AB, Tumba, Sweden

[21] Appl. No.: 295,603

[22] PCT Filed: May 4, 1988

[86] PCT No.: PCT/SE88/00229

§ 371 Date: Jan. 4, 1989

§ 102(e) Date: Jan. 4, 1989

[87] PCT Pub. No.: WO88/09107

PCT Pub. Date: Nov. 17, 1988

[30] Foreign Application Priority Data

May 7, 1987 [SE] Sweden ..... 87018909

[51] Int. Cl.[5] ..... H05B 6/68

[52] U.S. Cl. ..... 219/10.55 B; 219/10.55 F; 219/10.55 R; 361/91

[58] Field of Search ..... 219/10.55 B, 10.55 E, 219/10.55 R, 10.55 F, 10.55 A; 361/86, 91, 90; 331/86, 186; 315/95, 107; 328/267

[56] References Cited

U.S. PATENT DOCUMENTS

| | | | |
|---|---|---|---|
| 4,390,965 | 6/1983 | Albert | 219/10.55 B |
| 4,504,718 | 3/1985 | Okatsuka et al. | 219/10.55 B |
| 4,620,078 | 10/1986 | Smith | 219/10.55 B |

FOREIGN PATENT DOCUMENTS

| | | |
|---|---|---|
| 2155633 | 5/1973 | Fed. Rep. of Germany . |
| 3115517 | 2/1982 | Fed. Rep. of Germany . |
| 453043 | 1/1988 | Sweden . |
| 1162011 | 6/1985 | U.S.S.R. . |
| 888815 | 2/1962 | United Kingdom . |
| 1141071 | 1/1969 | United Kingdom . |

*Primary Examiner*—Philip H. Leung

*Attorney, Agent, or Firm*—Nies, Kurz, Bergert & Tamburro

[57] ABSTRACT

An arrangement for controlling the microwave power of magnetrons, in which a multiple of magnetrons are connected in parallel with a power unit (3) for generating a high magnetron-operating voltage, and which arrangement includes for each magnetron (1,2) a separate regulating circuit (9) which includes a current measuring circuit (10) for measuring the anode current passing through respective magnetrons, and in which arrangement the waveguides (70) to which the magnetrons are connected have earth potential. The invention is characterized in that the anode (4) of each magnetron (1, 2) is isolated electrically from the earth potential, in that the current measuring circuit (10) is connected between the anode (4) of the magnetron and the one terminal (23) of the power unit, and in that an over-voltage protector (78) is connected in parallel with the measuring circuit (10) for the purpose of limiting the voltage on the magnetron anode (4) in the event of a disruption in or failure of the measuring circuit (10).

15 Claims, 2 Drawing Sheets

Fig. 3
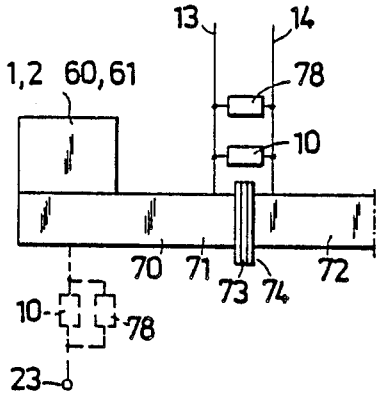
Fig. 4
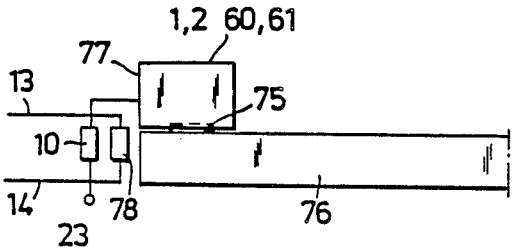
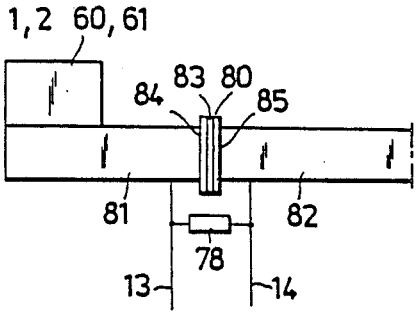
Fig. 5
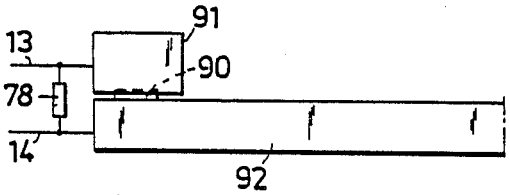
Fig. 6

ARRANGEMENT FOR CONTROLLING THE MICROWAVE POWER OF MAGNETRONS

BACKGROUND OF THE INVENTION

The present invention relates to a magnetron control arrangement.

Microwave heating is a technique which can be applied very advantageously in a number of processes which require the supply of thermal energy. One important advantage is that the heating power can be controlled in the absence of any inertia.

One drawback, however, is that microwave equipment is often more expensive than other conventional alternatives. Heating equipment includes, inter alia, a power unit with associated control system for driving the magnetron. Such a power unit and associated control system is responsible for the predominant part of the cost of such equipment. Since the power output of the magnetron is limited, it is often necessary to provide a significant number of magnetrons with associated power units and control systems to satisfy a given heating requirement.

Two types of magnetron are found, namely magnetrons whose magnetic fields are generated by a permanent magnet and magnetrons whose magnetic fields are generated by an electromagnet.

The strengths of the permanent magnets varies in manufacture and during operation. The magnetron construction includes a magnetic yoke, the permeability of which varies with temperature. Together with geometrical changes which occur with changes in temperature in the magnetron, changes also occur in the characteristic curve, seen as a graph in which anode voltage is plotted against anode current. The power output is proportional to the anode current, with a good degree of accuracy.

These facts are the reason why a multiple of magnetrons cannot be driven directly by a common voltage unit. The graph, or curve, exhibits a knee, the so-called knee voltage, above which the power output of the magnetron is greatly increased.

When two or more magnetrons are connected in parallel to a power unit and the magnetrons have slightly different characteristic curves, which is usually the case, one of the magnetrons will have a higher power output than the other. The magnetron which has the higher power output will become hotter than the other, causing the characteristic curve to fall so that the power unit produces a lower output voltage. In turn this causes the magnetron producing the lower power output to produce still less power, and so on until only one magnetron produces all power, because the knee voltage of the other magnetron is not reached.

One problem is therefore that each magnetron must be controlled individually, while at the same time endeavoring to reduce the number of power units with associated control systems.

A solution to this problem is disclosed in Swedish Patent Specification No. . . . (Swedish Patent Appln No 8602990-7), which solution is characterized in that two or more magnetrons are connected in parallel to a power unit for generating high voltage for operating the magnetrons; in that a separate regulating circuit for each magnetron is connected to respective magnetrons and includes measuring means for measuring the anode current through respective magnetrons on the high-voltage side of the magnetron; in that the measuring means is separated galvanically from a control circuit which is intended to control the anode current of the magnetron concerned in response to a signal from the measuring means.

Thus, according to this patent, the anode current is measured on the high voltage side of respective magnetrons. This means, among other things, that the measuring means must be separated galvanically from the control circuit.

One sound reason for measuring the anode current on the high-voltage side of the magnetron is because the anode of the magnetron is therewith directly earthed. Should the anode current simply be measured on the low-voltage side, the magnetron could be raised up to a high potential, which would be unacceptable from the aspect of safety.

However, it would be advantageous to be able to measure the anode current on the low-voltage side, since this would avoid the problem of separating the measuring circuits from the high operating voltage.

SUMMARY OF THE INVENTION

The present invention relates to an arrangement which enables the anode voltage to be measured on the low-voltage side, where the anode of the magnetron is unable to reach a dangerously high potential from the aspect of safety.

The present invention thus relates to an arrangement for controlling magnetrons with regard to their microwave power, in which arrangement a multiple of magnetrons are connected in parallel to a power unit for generating a high voltage for operating the magnetrons, and which includes a separate regulating circuit for each magnetron, said regulating circuits including a measuring means for measuring the anode current through respective magnetrons, and in which arrangement the waveguides to which the magnetrons are connected are connected to earth, said arrangement being characterized in that the anode of each magnetron is isolated from earth potential; in that said measuring means are connected between the anode of the magnetron and one terminal or pole of the power unit; and in that an overvoltage protector is connected in parallel with the measuring means for the purpose of limiting the voltage on the anode of the magnetron in the event of a failure or interruption in the measuring means.

BRIEF DESCRIPTION OF THE DRAWING

An exemplifying embodiment of the invention will now be described in more detail with reference to the accompanying drawings, in which:

FIGS. 3–6 illustrate different variants of a measuring means and an overvoltage protector.

DESCRIPTION OF PREFERRED EMBODIMENTS

Figure 1:
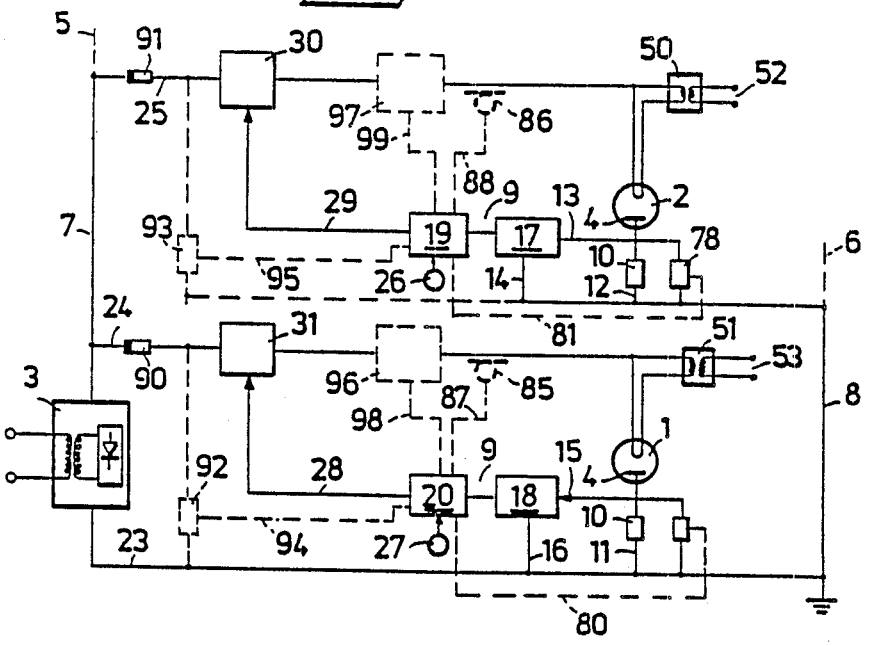
FIG. 1 illustrates schematically a circuit diagram for two or more magnetrons of the permanent magnet type.
Figure 2:
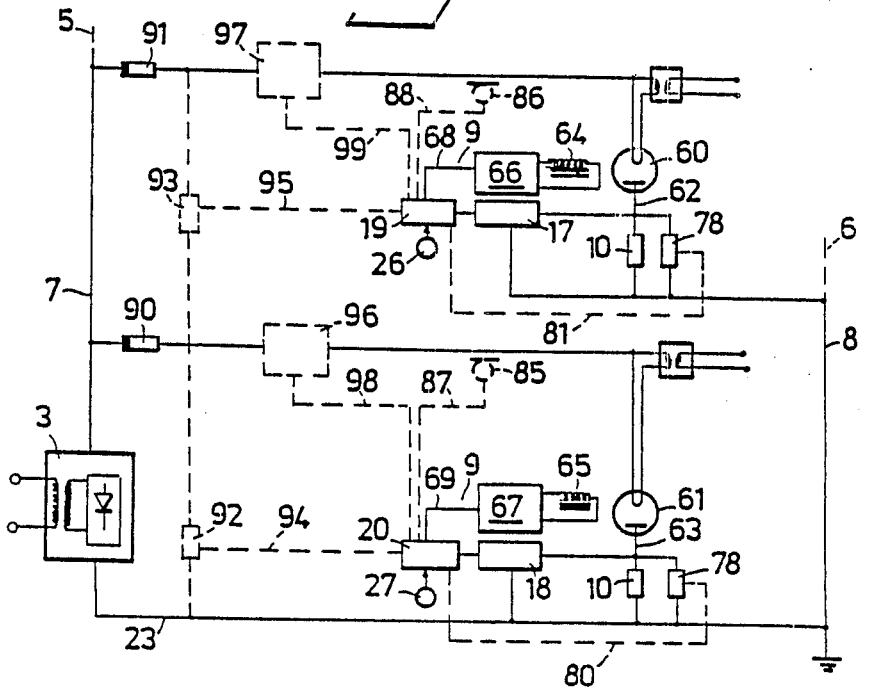
FIG. 2 illustrates schematically a circuit diagram for two or more magnetrons of the electromagnet type.

FIGS. 1 and 2 each illustrate schematically a circuit diagram for two or more magnetrons connected to a common power unit, the circuit diagram coinciding essentially with the circuit diagrams illustrated and described in the aforementioned patent specification, except that in the present case the anode voltage of the magnetrons is measured on the low-voltage side.

In FIG. 1 there are shown two magnetrons 1, 2 of the kind with which permanent magnets are used. These are supplied via a common power unit 3, which includes a transformer and a rectifier. The power unit may have an output voltage of, e.g., 3–4 kV.

The magnetrons 1, 2 are connected in parallel to the power unit 3. As indicated in FIG. 1, more magnetrons can be connected to the broken-line conductors 5, 6 in a manner similar to that in which the two magnetrons 1, 2 with associated circuits are connected to the conductors 7, 8.

Each magnetron has connected thereto a separate regulating circuit, generally referenced 9. The regulating circuit 9 includes a measuring means 10 which is intended to measure the anode current through respective conductors 11, 12. According to the invention, the measuring means is placed on the low-voltage side of the magnetron, between the anode 4 of the magnetron and the positive terminal of the power unit, which in the FIG. 1 embodiment is earthed. The measuring means preferably consists of a resistance R, across which the voltage is measured via conductors 13, 14; 15, 16. These conductors are connected to a measuring circuit 17, 18 of some suitable known kind and adapted to transfer the measured value in the form of said voltage to a control circuit 19; 20, either in analog or in digital form. The control circuit 19, 20 is intended to control the anode current of the magnetrons 1, 2 in response to a signal received from the measuring means 10. The control circuit, or device, 19, 20 suitably comprises a microprocessor or the like into which a control value concerning the desired power output is introduced. The voltage across the conductors 23, 24; 23, 25 connecting to the power unit may also be introduced into the control circuit. In this regard the control circuit is constructed to calculate the product of the last mentioned voltage and the anode current, which provides a relatively accurate measurement of the power output from respective magnetrons. The magnetrons have an efficiency of about 70%.

Naturally, the anode voltage - anode current diagram may be inserted into the control circuit instead, so that the control circuit calculates prevailing power output. The control circuit 19, 20 may be of any suitable known kind and may have any suitable construction.

The control value is given in the form of an electric signal. The signal preferably constitutes a measurement of the desired anode current. However, the signal may, instead, be influenced by an output signal from a temperature sensor in the volume or in the region in which the magnetron in question delivers its effect, regulation of temperature actually being effected by means of the power output. The reference numerals 26; 27 identify the setting device by means of which a control value is sent to the control circuit. As will be understood, this device may be an overriding control system in the form of a data processor or the like to which all of the magnetron control circuits are connected.

Thus, the control circuit obtains a control value from the device 26; 27 and a real or actual value from the measuring circuit 17; 18. The control circuit 19; 20 is intended to send a control signal, via conductors 28; 29, to a regulating circuit which includes control means 30, 31 for direct control of the anode current.

The control means may be configured in accordance with several preferred embodiments.

According to one embodiment the control means may be a peak voltage unit which may either be constructed to supply a high voltage to the voltage generated by the power unit, as described in the aforesaid patent specification, or may be constructed to lower the voltage generated by the power unit, as also described in said patent specification.

Thus, a common power unit can be used for two or more magnetrons with permanent magnets, by connecting solely a cheap and simple peak voltage unit to each of the magnetrons. Each of the magnetrons can be controlled by the peak unit to produce the desired power irrespective of the prevailing power output of remaining magnetrons.

Each magnetron may also have connected thereto, in a conventional manner, a filament transformer 50; 51 which is supplied from a voltage source 52; 53.

According to the invention, when the magnetrons are of the kind with which their magnetic field is generated by means of a magnetic coil a separate magnetizing unit intended for each magnetron and connected to the coil, or winding, is controlled by the control circuit such that the strength of the magnetic field in the magnetron at the present voltage across the magnetron will give a predetermined anode current through the magnetron.

FIG. 2 illustrates an example of one such embodiment. Those components in FIG. 2 which have correspondence in FIG. 1 have been given the same reference numerals. Thus, there is shown in FIG. 2 a power unit 3 and conductors 7, 8. The measuring means 10, the measuring circuit 17; 18, the control circuit 19; 20 and the device 26; 27 can be arranged in the same manner as that described in the aforegoing.

Consequently, the measuring means of this embodiment is also located between the anode 62; 63 of the magnetron and the positive terminal of the power unit 3, which is earthed in the FIG. 2 embodiment.

The magnetrons 60, 61 are provided with a magnetic coil or winding 64, 65 with an associated magnetic core for generating a magnetic field in the magnetrons. Such magnetrons can also be provided with a permanent magnet, although this magnet alone is not able to generate a sufficiently strong magnetic field to enable microwaves to be generated.

Magnetization is effected with the aid of a separate magnetizing unit 66; 67 for each magnetron, this unit being a current unit which supplies current to the magnetic coils 64; 65. In the aforesaid diagram, the anode voltage - anode current curve moves up and down with the strength of the magnetic field. Thus, in this embodiment the voltage across the magnetron is mainly constant, whereas the power output is controlled or regulated by lowering or raising said curve. This is achieved by regulating the current through the magnetic coils.

Similar to what has been described above, the control circuit 19; 20 obtains a control value and a real value. The control circuit of this embodiment is constructed to send a control signal to the magnetizing unit 66; 67 via a conductor 68; 69, thereby controlling the unit in a manner such that the magnetic field strength in the magnetron at the voltage prevailing across the magnetron gives a pre-determined anode current through the magnetron.

The magnetizing units 66, 67 include a rectifier and a current regulating device, such as a transistor or the like. The transistor or corresponding device is controlled by means of the aforesaid control signal.

Any suitable circuit can be used to this end. The magnetizing unit 66; 67 is suitably supplied, via a transformer, from a voltage source, which may, for instance, be a 380 Volt alternating current.

It will be readily understood that further magnetrons with associated regulating circuits can be connected in parallel to the power unit, via the broken line conductors 5, 6 in FIG. 2.

Since the waveguides connected to the magnetrons should be earthed from the aspect of safety, the potential is common in all microwave systems. The potential of the magnetron casings is normally the same as the anode potential and the casings are galvanically connected to one another via the waveguide connections specified by magnetron manufacturers. The waveguides and the anode obtain thereby the same potential. The positive terminal or pole of the drive voltage is common and consequently a resistor between respective magnetron anodes and positive terminals should be connected in parallel to all magnetrons and the voltage across all resistors the same.

According to the present invention the anode of each magnetron is therefore isolated electrically from earth potential, so that the measuring means 10 increases the potential of the magnetron anode and therewith the magnetron casing to a level which lies slightly above earth potential.

As will be understood from the aforegoing, the voltage across the measuring means 10 is utilized as the real value of the magnetron anode current passing to the regulating circuit 9.

The fact that the anode and the casing of the magnetrons are not connected directly to earth potential may constitute a safety hazard should a fault occur, unless particular safety measures are taken.

Various kinds of faults or malfunctions can occur.

Firstly, the measuring means may be short circuited. In this case the voltage drop across the measuring means will be zero, and consequently the regulating circuit will attempt to increase the voltage across the magnetron, or alternatively the current through the magnetic coils 64, 65. This does not constitute a safety hazard, however, since the anode is earthed.

Secondly, a break or disruption may occur in the measuring means. In this case the anode voltage will rise to a high voltage. The voltage drop across the measuring means will also rise, however, causing the regulating circuit to decrease the voltage across the magnetron, or alternatively the current through the magnetic coils 64, 65.

Thirdly, a short circuit may occur in the magnetron, causing the anode voltage to rise to a high level. This will cause the measuring means to burn out, causing the measuring means to break down or to be short circuited.

These three cases may occur individually or in sequence, where the faults of each of the aforesaid cases result in a fault according to another case.

In accordance with the invention, an overvoltage protector is connected in parallel to the measuring means, this overvoltage protector being intended to limit the voltage which can occur on the anode when the second or the third of said faults occur.

According to one preferred embodiment of the invention the aforesaid measuring means 10 comprises a resistor R of low resistance, e.g. a resistance of 0.1 to 10 Ohms, preferably 0.5 Ohms.

According to a first embodiment, FIG. 3, each waveguide 70 to which a magnetron 1, 2; 60; 61 is connected and which is intended to guide microwave energy to a consumer location, is electrically interrupted by means of a join 74 between two waveguide parts 71, 72. Located in the join between the waveguide parts 71, 72 is a thin plate 73 which is made of electrically insulating material, preferably a plastics material, such as Teflon (Registered Trade Mark), so as to separate electrically the anode of the magnetron from the potential of the waveguide part 72, see FIG. 3.

The join 74 is suitably placed as close to the magnetron as is favourable in practice, since the waveguides 72 should be earthed from the aspect of safety.

According to one embodiment, the measuring means 10 is connected between the two waveguide parts 71, 72 connected by the join 74.

According to another variant the measuring means 10 is connected between the positive terminal 23 of the power unit and the anode of the magnetron, as indicated by broken lines in FIG. 3. Since the waveguide part 71 in which the magnetron is attached is in metallic contact with the anode and the casing of the magnetron 1, 2, 60, 61, the measuring means may be connected directly to the anode of the magnetron or, as indicated in FIG. 3, to the waveguide part 71.

According to a second embodiment, FIG. 4, the magnetron 1, 2, 60, 61 is a modification of a conventional magnetron. Normally there is provided on a magnetron at its connection location an electrically conductive sealing plate which is intended to prevent the leakage of microwaves to the surroundings. According to this second embodiment, the sealing plate 75 is made of an electrically non-conductive material, preferably from a ceramic or plastics material. Consequently, the attachment screws or like fasteners normally present between the magnetron casing and the waveguide 70 as in FIG. 3 are electrically isolated from the waveguide. Thus, in this case, the magnetron is electrically isolated from the waveguide 76. In the case of this embodiment the measuring means is connected between the positive terminal 23 of the power unit and the anode of the magnetron, or, as shown in FIG. 4, its casing 77. The waveguide 76 of this embodiment is thus not provided with a join corresponding to the join 74 in FIG. 3.

The overvoltage protector 78 of these two embodiments is connected in parallel to the measuring means 10.

According to a third embodiment, FIG. 5, each of the waveguides is provided with a join 80 corresponding to the join 74 in FIG. 3, where the two waveguide parts 81, 82 (see FIG. 5) are connected with a plate 83 having a known resistance, preferably a so-called semiconductor plate, such as a so called diode plate of a suitable known kind. The plate 83 has a resistance of, e.g. 0.5 Ohm and forms the measuring means 10.

According to one variant of the third embodiment, the overvoltage protector 78 is connected between the two waveguide parts 81, 82.

According to another variant of the third embodiment, the overvoltage protector consists of an air gap in the join 80, namely between the fins 84, 85 of the waveguide parts. The length of the air gap thus corresponds to the thickness of the plate 83. Thus, this embodiment has no overvoltage protector in the form of a separate component, such as the component 78. The length of the air gap is herewith adapted to the highest voltage capable of being taken by the magnetron and thus concerns parts of a millimeter.

According to a fourth embodiment, FIG. 6, the sealing plate 90 intended to prevent microwave leakage to the surroundings is made of a material which has limited electrical conductivity, such as a resistance of about 0.1 to 10 Ohms. The plate 90 may, in this case, be made of a metal of low electrical conductivity or some other suitable material. For instance, the material may be kanthal or konstantan. The plate 90 is therewith intended to form a screen against the leakage of microwaves and also to form the measuring means 10. The overvoltage protector 78 is arranged between the anode of the magnetron or the magnetron casing 91 and the waveguide 92 in which it is connected.

When the overvoltage protector 78 is not formed by an air gap, which is mentioned above as one embodiment, the overvoltage protector may comprise different components.

A convenient component in this regard will comprise one or more diodes which are connected in parallel and which will only conduct a small current, or which will conduct no current at all, in normal operation, i.e. when current flows through the measuring means 10, but which when the measuring means is disrupted or breaks down will conduct a current of such high value as to limit the voltage level of the magnetron anode to levels which are innocuous to human beings.

The overvoltage protector may, in accordance with another variant, comprise a resistance of higher value than the measuring resistance, for example which is ten times higher than the resistance of the measuring means 10.

According to a third embodiment, the overvoltage protector may comprise a discharge tube which begins to conduct current when the voltage level of the magnetron anode has increased but lies beneath those values which are dangerous to human beings. Instead of a discharge tube, the overvoltage protector may comprise a discharge component having a controlled grid level, such as a thyratron. When a thyratron is used, the thyratron discharge can be controlled by the control circuit 19, 20 via a conductor 80, 81 shown in broken lines in FIGS. 1 and 2. In this case, the control circuit 19, 20 is intended to activate the overvoltage protector when the voltage across the measuring means 10 exceeds a pre-determined level, e.g. 50 V.

It will be understood that the skilled person may elect to use the aforesaid components for the overvoltage protector, or may choose in this regard other components from a number of well known, commercially available components not listed here.

Three different malfunctions or faults have been mentioned in the aforegoing, namely short circuiting of the measuring means, a breakdown or interruption in the measuring means, and short circuiting of the magnetron. In these last two cases the overvoltage protector will thus conduct current in a manner to limit the potential of the magnetron casing, the performance and characteristics of the overvoltage protector being selected with regard to the desired maximum potential of the magnetron casing. This choice lies will within the capabilities of the skilled person, based on the voltage generated by the voltage unit and the resistance presented by the length extension of the overvoltage protector or the air gap.

In addition to preventing the anode voltage level from reaching dangerously high values, the overvoltage protector also protects the regulating circuits 9 from being subjected to high voltages.

It will be clearly apparent from the aforegoing that when one or more of the aforesaid faults occur, the inventive construction of the arrangement will ensure that the voltage level of the anode or casing of the magnetron is restricted to values which are below those at which human beings are placed at risk.

It is desirable, however, that the voltage supply to a malfunctioning or faulty magnetron is interrupted when a fault of the aforesaid kind occurs. This can be effected in several different ways.

As beforementioned, the control circuit 19, 20 can be constructed to detect when the voltage across the measuring means changes suddenly despite the fact that the control circuit 19, 20 has not activated the control device 30, 31 or the magnetizing unit in a manner to cause such a rapid change in the voltage of the measuring unit.

Another method of detecting the occurrence of a malfunction or fault is to provide a current transformer 85, 86 on the high-voltage side of the magnetron and to connect this transformer to a separate detector, e.g. a peak detector. As illustrated in FIGS. 1 and 2, the current transformer may be connected, instead, to the control circuit 19, 20 via conductors 87, 88, which control circuit is therewith arranged to detect rapid changes in current on the high-voltage side.

Thus, when there occurs across the measuring means a voltage change which is not is response to activation of the magnetron concerned by the control circuit, or when a rapid change in current occurs on the high-voltage side, the control circuit 19, 20 is arranged, in accordance with the invention, to activate one or more means for interrupting the voltage supply to the magnetron concerned.

Arranged between each magnetron and the power unit is a fuse or cut-out device 90, 91. One method of interrupting the voltage supply is to engender a current surge such as to quickly trigger the fuse or cut-out device 90, 91. According to one embodiment there is provided to this end, a triggerable discharge tube 92, 93, such as a thyratron, which is connected in parallel to the terminals of the power unit, but downstream of the fuse or cut-out device 90, 91.

When a fault is detected by the control circuit 19, 20 in the aforesaid manner, the control circuit will trigger the triggerable discharge tube 92, 93 via conductors 94, 95. This results in a surge of current through the discharge tube 92, 93, such as to trigger the fuse 90, 91.

In the event of a short circuit occurring in the magnetron there will occur therewith in the secondary circuit of the power unit a current surge of such magnitude as to enable the fuse or cut-out device 90, 91 to be dimensioned to be triggered even when no triggerable discharge tube 92, 93 is present.

Alternatively, the voltage supply may be interrupted by causing the control circuit 19, 20 to activate an electromagnetic contact breaker or switch 96, 97, via conductors 98, 99.

It will be obvious to those skilled in this art that other alternative circuits are conceivable for interrupting the voltage supply to a malfunctioning or faulty magnetron or to the regulating circuits belonging to said magnetron.

It will be understood from the aforegoing that the present invention enables measuring of the anode current for the purpose of controlling magnetrons to be effected on the low-voltage side, where the anode current of each magnetron is measured separately without risk of the magnetron casing adopting levels which are dangerous to human beings.

A number of exemplifying embodiments and a number of different preferred components have been described in the aforegoing.

It will be understood, however, that modifications can be made within the expertise of the skilled person so that fully equivalent circuits and functions are obtained.

The present invention is therefore not limited to the aforedescribed exemplifying embodiments but can be modified within the scope of the following claims.

We claim:

1. In a microwave heating apparatus including a power unit, a plurality of magnetrons, each having an anode, connected in parallel with the power unit, said power unit having two output terminals, one of which is grounded, enabling generation of a requisite high magnetron-operating voltage, a plurality of waveguides each of which is connected to an associated magnetron, a controlling device comprising for each magnetron (1, 2; 60, 61): a separate regulating circuit (9) which includes a measuring means (10) for measuring the anode current through respective magnetrons; the waveguides (70), to which the magnetrons are connected, are connected to said ground potential; an electrically isolating means connecting the anode (4; 62, 63) of each magnetron (1, 2; 60, 61) to the grounded waveguide so that each said anode is isolated electrically from the ground potential; each said measuring means 91) being connected between the anode (4; 62, 63) of its associated magnetron and the other said output terminal (23), of the power unit (3), which has a positive potential; and an overvoltage protector (78) is connected in parallel to each said measuring means (10) so as to limit the voltage on the associated anode (4; 62, 63) of its associated magnetron in the event of a disruption or break-down of the associated measuring means (10).

2. An arrangement according to claim 1, characterized in that each said waveguide (7) has at least two parts insulated electrically from each other by a joinder means (74) comprising a thin piece of electrically insulating material (73) and the anode (4; 62, 63) of the associated magnetron is connected to one of said waveguide parts and, because of said electrically insulating material is separated electrically from the ground potential of the remaining part of said waveguide.

3. An arrangement according to claim 2, characterized in that the measuring means (10) is connected between the two waveguide parts (71, 72) joined at said joinder means (74).

4. An arrangement according to claim 2, characterized in that the measuring means (10) is connected directly between the positive terminal (23) of the power unit and the anode (4; 62, 63) of the magnetron.

5. An arrangement according to claim 1, characterized in that a sealing plate (75) made of an electrically nonconductive material is provided on the magnetron (1, 2; 60, 61) at its connection location to said waveguide, for the purpose of preventing the leakage of microwaves to the surroundings; and in that the measuring means (10) is connected between the positive terminal (23) of the power unit and the anode (4; 62, 63) of the magnetron.

6. An arrangement as defined in claim 5, wherein said sealing plate (75) is made from a ceramic material.

7. An arrangement as defined in claim 5, wherein said sealing plate (75) is made from a plastic material.

8. An arrangement according to claim 1, characterized in that the measuring means (10) comprises a resistance.

9. An arrangement according to claim 1, characterized in that a sealing plate 990) is located on the magnetron at its connection location to said waveguide to prevent leakage of microwaves to the surroundings said sealing plate being made of material of limited electrical conductivity, having a resistance of about 0.1 to 10 Ohms, said plate therewith will form a screen against the leakage of microwaves and also provides a measuring resistor, and said overvoltage protector (78) is arranged between the anode (4; 62, 63) of the magnetron and the waveguide (70) in which it is connected.

10. An arrangement according to claim 1, characterized in that each of the waveguides (70) is provided with a joinder means (8) in which the measuring means in the form of a plate (83) having a predetermined resistance is arranged.

11. An arrangement according to claim 10, characterized in that the overvoltage protector (78) comprises an air gap in said joinder means (80), said air gap corresponding to the thickness of the plate (83).

12. An arrangement as defined in claim 10, wherein said measuring means in the form of a plate is a semiconductor diode plate.

13. An arrangement according to claim 1, wherein said measuring means (10) comprises a resistor and said overvoltage protector (78) comprises a resistor of higher resistance than the measuring means resistor (10).

14. An arrangement according to claim 1, characterized in that the overvoltage protector (78) comprises a discharge tube.

15. An arrangement according to claim 1, characterized in that the overvoltage protector (78) comprises one or more diodes connected in parallel.

* * * * *